US006939121B2

(12) United States Patent
Giri et al.

(10) Patent No.: US 6,939,121 B2
(45) Date of Patent: Sep. 6, 2005

(54) FORM WITH DISPLACEABLE VIBRATORY PANEL

(75) Inventors: Kiran P. Giri, Leawood, KS (US); Siddanagouda Kandagal, Bangalore (IN)

(73) Assignee: GCI Pipe Products, Inc., Shawnee, KS (US)

( * ) Notice: Subject to any disclaimer, the term of this patent is extended or adjusted under 35 U.S.C. 154(b) by 116 days.

(21) Appl. No.: 10/368,839

(22) Filed: Feb. 18, 2003

(65) Prior Publication Data

US 2004/0159060 A1 Aug. 19, 2004

(51) Int. Cl.[7] ..... B28B 1/087
(52) U.S. Cl. ..... 425/432; 425/DIG. 127
(58) Field of Search ..... 425/432, DIG. 127

(56) References Cited

U.S. PATENT DOCUMENTS

| | | | | | |
|---|---|---|---|---|---|
| 2,165,671 | A | * | 7/1939 | Ward | 425/432 |
| 2,353,492 | A | * | 7/1944 | O'Connor | 425/432 |
| 2,407,168 | A | * | 9/1946 | Lindkvist | 425/432 |
| 2,512,117 | A | * | 6/1950 | Sims | 425/432 |
| 2,732,605 | A | * | 1/1956 | Johnson | 425/432 |
| 2,896,299 | A | * | 7/1959 | Hemb | 425/432 |
| 2,961,731 | A | | 11/1960 | Buzzell et al. | |
| 3,555,599 | A | * | 1/1971 | Weinhold | 425/432 |
| 3,712,785 | A | * | 1/1973 | Hirt et al. | 425/432 |
| 3,743,468 | A | * | 7/1973 | Helmrich et al. | 425/432 |
| 3,756,762 | A | * | 9/1973 | Maugweller | 425/432 |
| 3,764,242 | A | * | 10/1973 | Fischer | 425/432 |
| 3,827,847 | A | * | 8/1974 | Weaver | 425/432 |
| 3,932,099 | A | * | 1/1976 | Burdy et al. | 425/432 |
| 3,994,660 | A | * | 11/1976 | Ravet | 425/432 |
| 4,119,692 | A | * | 10/1978 | Durinck | 425/432 |
| 4,219,513 | A | | 8/1980 | Miller | |
| 4,725,220 | A | * | 2/1988 | Percinel et al. | 425/432 |
| 4,969,626 | A | | 11/1990 | Strauch | |
| 5,076,536 | A | | 12/1991 | Fitzgerald | |
| 5,301,918 | A | | 4/1994 | Miller | |
| 5,651,913 | A | | 7/1997 | Lee | |
| 5,984,571 | A | | 11/1999 | Owens | |
| 6,164,618 | A | | 12/2000 | Yonemura | |

OTHER PUBLICATIONS

Prior art box culvert form from Mid–America Manufacturing Corporation of Jonesboro, Arkansas, as disclosed in the information sheet attached hereto as Exhibit A.

* cited by examiner

*Primary Examiner*—James P. Mackey
(74) *Attorney, Agent, or Firm*—Hovey Williams LLP

(57) ABSTRACT

A modular forming system (10) configured for forming concrete box culverts is disclosed. The inventive system (10) includes displaceable panels for forming the concrete that are vibrated relative to stationary frames to compact the concrete enabling denser, stronger finished concrete to be formed with lighter weight, lower maintenance, longer lasting frames. The system (10) broadly includes a pallet (12), a core (14), a jacket (16), and a header (18). The jacket (16) encircles the core (14) and is supported on the pallet (12) and is operable to mold the outside circumferential surface of the culvert. The jacket (16) includes a plurality of modular sections (20–32) and each section includes a stationary frame (34), a displaceable vibratory panel (36), a plurality of spring assemblies (38–68) shiftably coupling the panel (36) to the frame (34), and a vibrator (70) coupled to the panel (36) for reciprocating the panel (36) relative to the frame (34). In a preferred embodiment, the panels are supported on the frames by a specified number of uniform springs generally determined by the formula: $N=(32n\,\pi^2f^2D^3W)/(Gd^4)$ wherein N=number of springs needed, n=number of active turns in each spring, $\pi$=22/7, f=frequency of vibration of the panel (Hz), D=mean coil diameter of each spring (m), W=weight of the panel (kg), G=shear modulus of the spring material ($N/m^2$), and d=wire diameter of each spring (m). Each of the panels is vibrated by an eccentric motor that is adjusted to vibrate the respective panel at or about a resonant frequency. In this manner, all of the panels vibrate synchronous in resonance, thereby providing optimum external concrete compaction.

28 Claims, 5 Drawing Sheets

FORM WITH DISPLACEABLE VIBRATORY PANEL

BACKGROUND OF THE INVENTION

1. Field of the Invention

The present invention relates generally to systems for forming concrete. More specifically, the present invention concerns a forming system having a displaceable panel for forming the concrete that is vibrated relative to a stationary frame to compact the concrete. The forming system of the present invention is particularly well suited for forming box culverts. In a preferred embodiment, a plurality of the displaceable panels are independently supported on modular frames by a specified number of springs that enable each of the panels to be vibrated at or about a resonant frequency, thereby providing optimum external concrete compaction. The inventive forming system enables denser, stronger finished concrete to be formed with lighter weight, lower maintenance frames that are longer lasting than previous systems.

2. Discussion of Prior Art

Those ordinarily skilled in the construction industry will appreciate that when forming concrete, it is desirable to reduce the air voids in the wet concrete to a minimum in order to obtain a denser mass for the finished, hardened concrete. Air voids are reduced by compacting the concrete. Compaction can occur internally (e.g., by stirring the concrete), externally (e.g., by vibrating the concrete itself), or with the use of a table (e.g., by vibrating the entire form). In relatively larger forming applications, compaction is primarily accomplished externally and its impact is directly related to both the amplitude and frequency of the vibration. One such application is pre-cast concrete box culverts. Pre-cast concrete box culverts are a desired solution over cast-in-place culverts for a wide variety of applications such as highway bridges and drainage conditions, such as storm and sanitary sewers. These pre-cast culverts come in a variety of sizes (e.g., various rises, spans, thicknesses, etc.) but typically come in relatively large, standard lengths, such as six, eight and ten feet and have a typical thickness of about one-half meter. The culverts can be joined together lengthwise at the ends (e.g., with mastic, gaskets, etc.) to form the desired run.

Forming systems for forming the pre-cast concrete box culverts are known in the art. These prior art forming systems typically include modular components, such as cores, jackets, and pallets, in combination with some type of header. One example of such a forming system is disclosed in the Application for U.S. Letters patent Ser. No. 10/279,255, entitled MODULAR FORMING SYSTEM FOR BOX CULVERT, filed Oct. 23, 2002 (having a common inventor and assigned to the same assignee as the present application and hereinafter "the '255 Application"), which is hereby incorporated herein by reference. The forming system disclosed in the '255 Application was an advance in the art at the time and included easily assembled modular components, including a modular header. The forming system of the '255 Application, however, like all prior art forming systems for box culverts, utilized rigidly formed jacket sections that are vibrated with one or more eccentric motors. These systems provide some amplitude that facilitates compaction, but do not enable the desired frequencies to provide a more optimum compaction of the concrete.

It is also known in the art of forming concrete to form the concrete in a rigid form that is supported on a vibrating table.

However, like the systems described above, the vibrating tables simply do not provide the desired frequency to enable compaction throughout the concrete. Additionally, the tables are limited in their application and are not well suited for relatively larger forms. Vibrating screeds are also known in the art for finishing concrete and typically include a portable frame and an adjustable panel fixed to the frame that are both vibrated by a motor. The screeds are typically moved over the finishing surface only. In this regard, the screeds do not form any of the other surfaces and are not suited for compacting larger concrete applications such as the box culverts discussed above.

These prior art forming systems are problematic and subject to several limitations. For example, as indicated above, the forming systems simply cannot provide the necessary frequencies throughout the thickness of the concrete to optimize compaction. In this regard, as applied to box culverts, the concrete formed in these prior art systems must typically be mixed at least in a ratio of 1:3 water to dry mix. However, a dryer mix is more desirable as it enables a denser and thus stronger finished product. Additionally, the prior art forming systems are typically associated with high maintenance costs and reduced longevity of the frames, as well as the vibrators. These limitations are largely attributable to the vibration of the rigid forming sections, as well as the amplitude of the vibration used. Furthermore, during vibration of the forms, the bolts that hold the jacket together are undesirably prone to becoming loose and thereby compromising the mold, therefore, prior art jackets typically include heavy, rigid frames to compensate for this limitation. These problems and limitations are undesirable in that they add increased labor and/or expense to manufacturing, assembling, and maintaining the forming systems.

SUMMARY OF THE INVENTION

The present invention provides an improved concrete forming system, particularly well suited for forming box culverts, that does not suffer from the problems and limitations of the prior art forming systems detailed above. The inventive forming system includes a displaceable panel for forming the concrete that is vibrated relative to a stationary frame to compact the wet concrete prior to hardening. In a preferred embodiment, a plurality of the displaceable panels are independently supported on modular jacket frames by a specified number of springs that enable each of the panels to be vibrated at or about a resonant frequency, thereby providing optimum external concrete compaction. The inventive forming system enables denser, stronger finished concrete to be formed with lighter weight, lower maintenance frames that, along with the vibrators, are longer lasting than previous systems.

A first aspect of the present invention concerns a form for forming concrete broadly including a frame operable to remain stationary as concrete is molded in the form, a displaceable panel associated with the frame and being operable to engage the concrete to thereby mold the concrete, a plurality of springs shiftably coupling the panel to the frame, and a vibrator operable to reciprocate the panel relative to the frame as the concrete is molded.

A second aspect of the present invention concerns a method of forming concrete broadly including the steps of supporting a frame relative to the ground, supporting a panel relative to the frame, pouring concrete against the panel to mold the concrete, and vibrating the panel relative to the frame while the concrete is molded so that the frame remains stationary relative to the molding concrete and the panel is displaced relative to the frame.

A third aspect of the present invention concerns a modular forming system for forming concrete into a box culvert having opposite faces. The system broadly includes a core operable to mold the inside circumferential surface of the culvert, a pallet supported relative to the ground and encircling the core and being operable to mold one of the faces of the culvert, a jacket supported generally vertically relative to the ground on the pallet and spaced from the core and being operable to mold the outside circumferential surface of the culvert, and a header encircling the core and being operable to slide between the core and the jacket and being operable to mold the other face of the culvert. The jacket includes a plurality of sections removably coupled to each other. Each of the sections includes a corresponding frame, a panel, a plurality of springs shiftably coupling the panel to the frame, and a vibrator coupled to the panel for reciprocating the panel relative to the frame.

In a preferred embodiment of the forming system, a plurality of the displaceable panels are independently supported on light weight modular jacket frames by a specified number of uniform springs. The number of springs associated with each panel is generally determined by the formula: $N=(32n\pi^2f^2D^3W)/(Gd^4)$ wherein N=number of springs needed, n=number of active turns in each spring, $\pi=22/7$, f=frequency of vibration of the panel (Hz), D=mean coil diameter of each spring (m), W=weight of the panel (kg), G=shear modulus of the spring material ($N/m^2$), and d=wire diameter of each spring (m). Each of the panels is vibrated by an eccentric motor that is adjusted to vibrate the respective panel at or about a resonant frequency. In this manner, all of the panels vibrate synchronous in resonance, thereby providing optimum external concrete compaction.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

Figure 3:
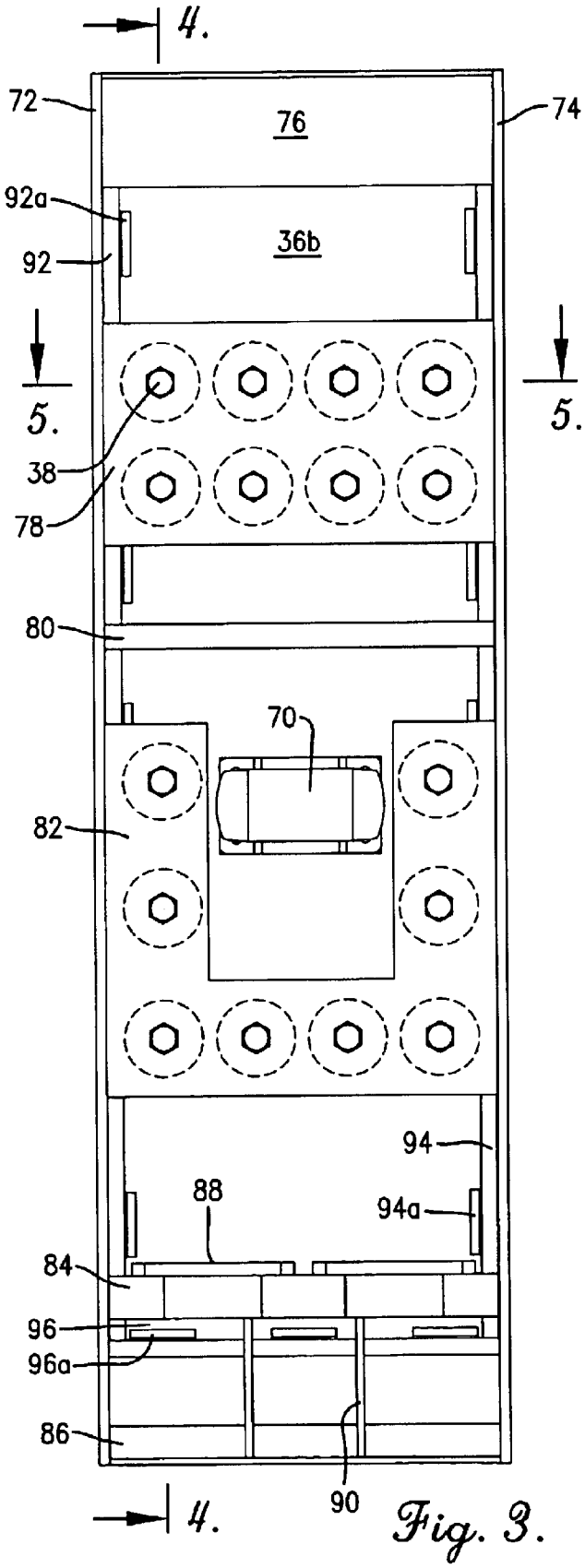
FIG. 3 is a rear elevational view of the jacket section illustrated in FIG. 2.
Figure 4:
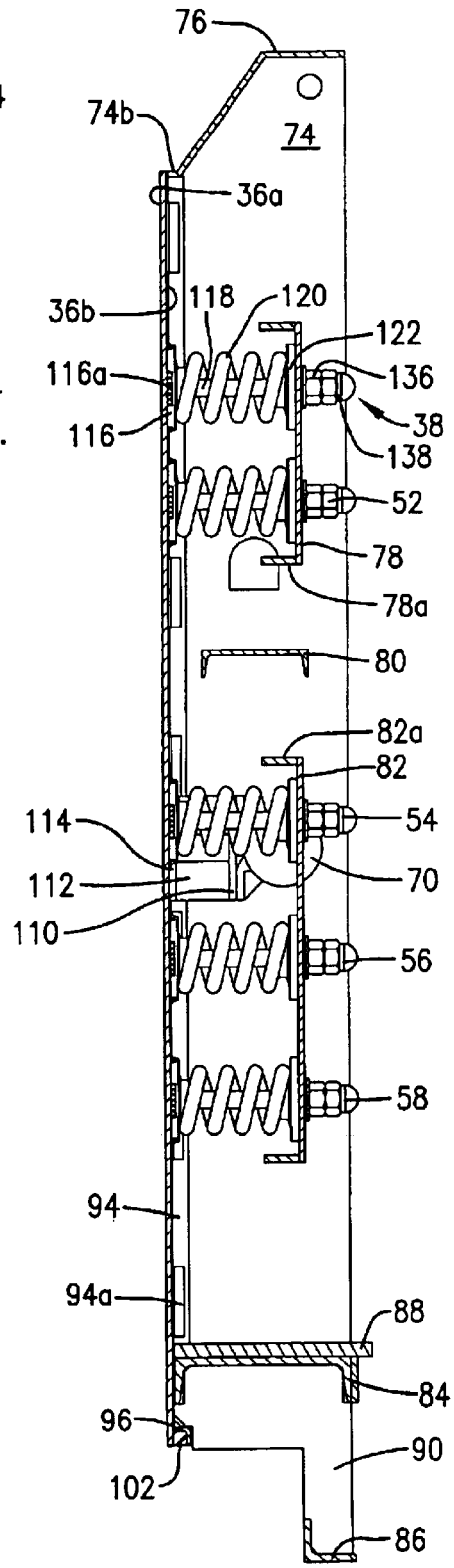
FIG. 4 is a sectional view of the jacket section taken substantially along line 4—4 of FIG. 3.
Figure 5:
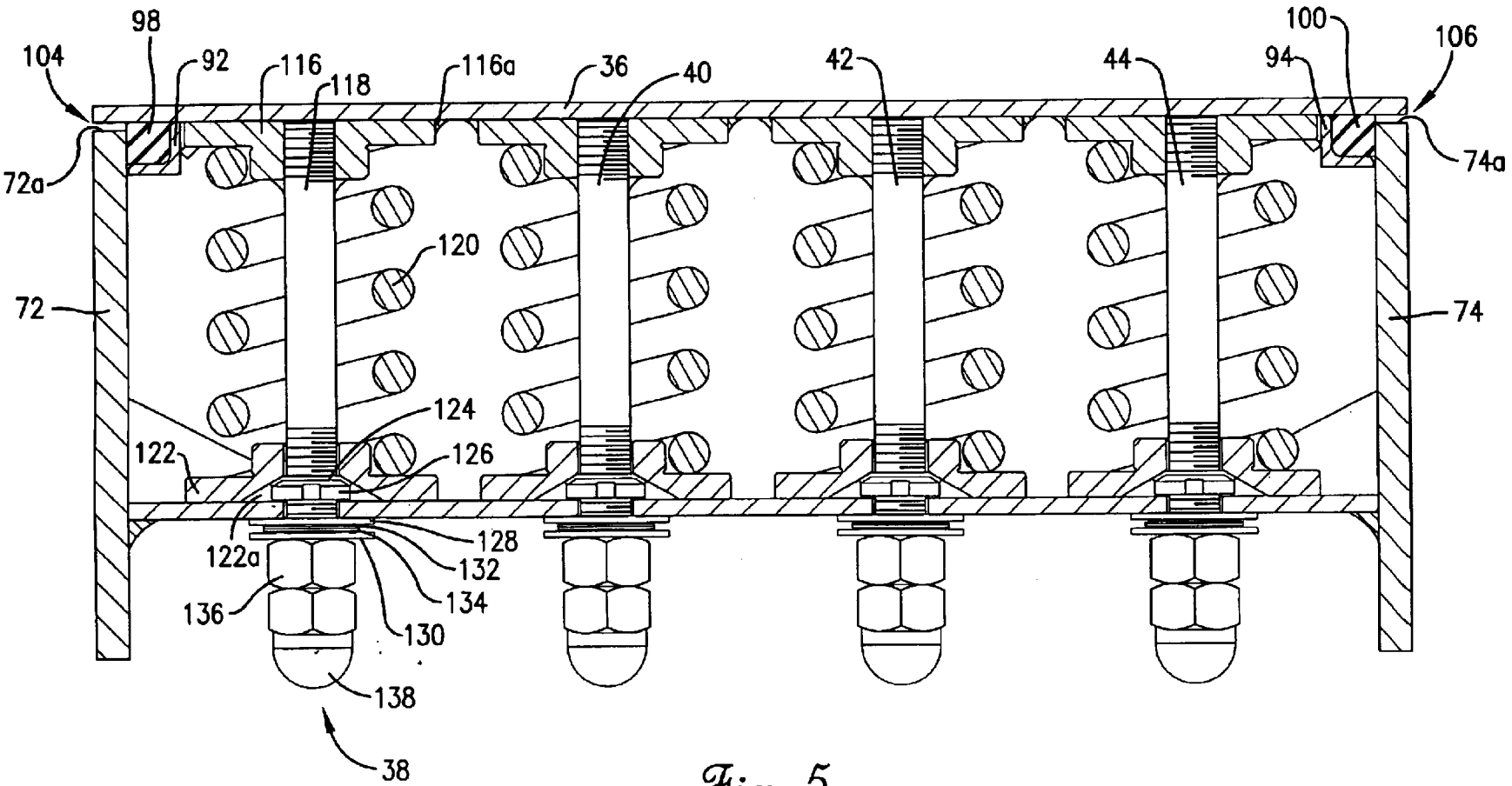
Figure 6:
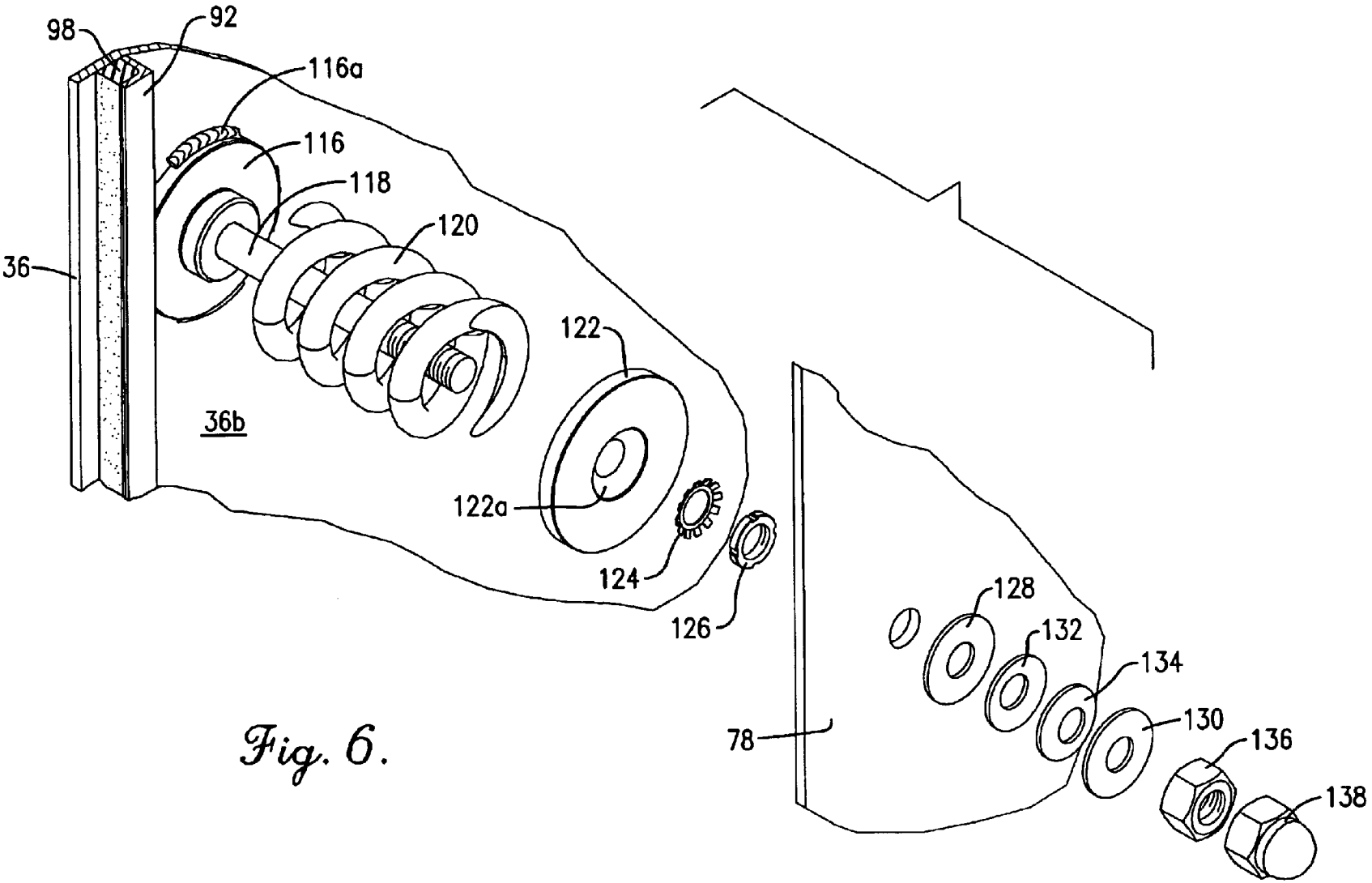

FIG. 5 is an enlarged sectional view of the jacket section taken substantially along line 5—5 of FIG. 3 particularly illustrating the spring coupling between the frame and the displaceable panel as well as the gap between the panel and the forward-most edges of the frame sidewalls; and FIG. 6 is a fragmentary enlarged and exploded assembly view of the jacket section illustrated in FIGS. 2–5 particularly showing the assembly of the components of one of the spring couplings between the frame and the displaceable panel.

DETAILED DESCRIPTION OF THE PREFERRED EMBODIMENTS

Figure 1:
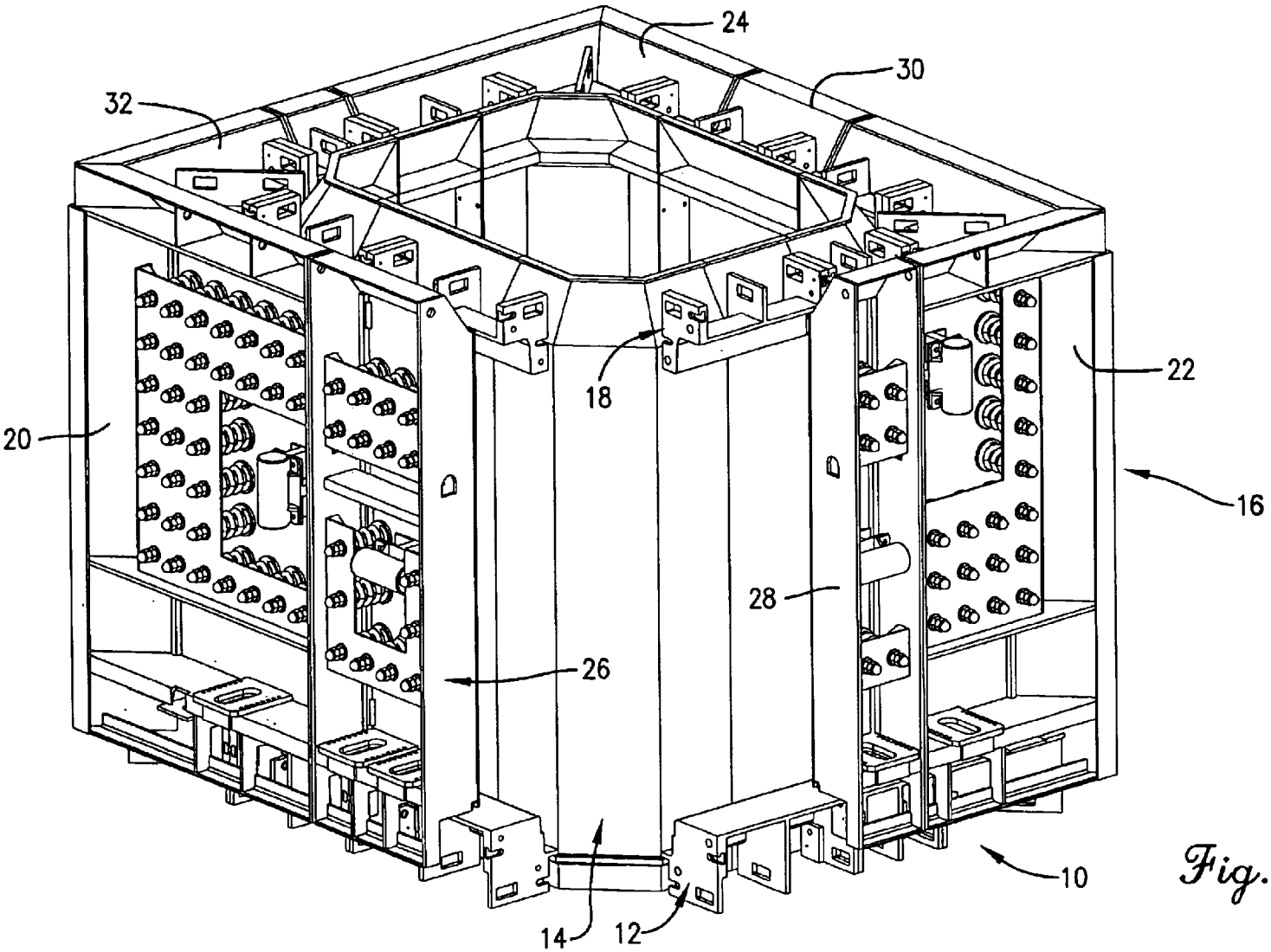
FIG. 1 is a perspective view of a forming system constructed in accordance with a preferred embodiment of the present invention with portions of the header, the jacket, and the pallet removed to illustrate features of those components and the core.
Figure 2:
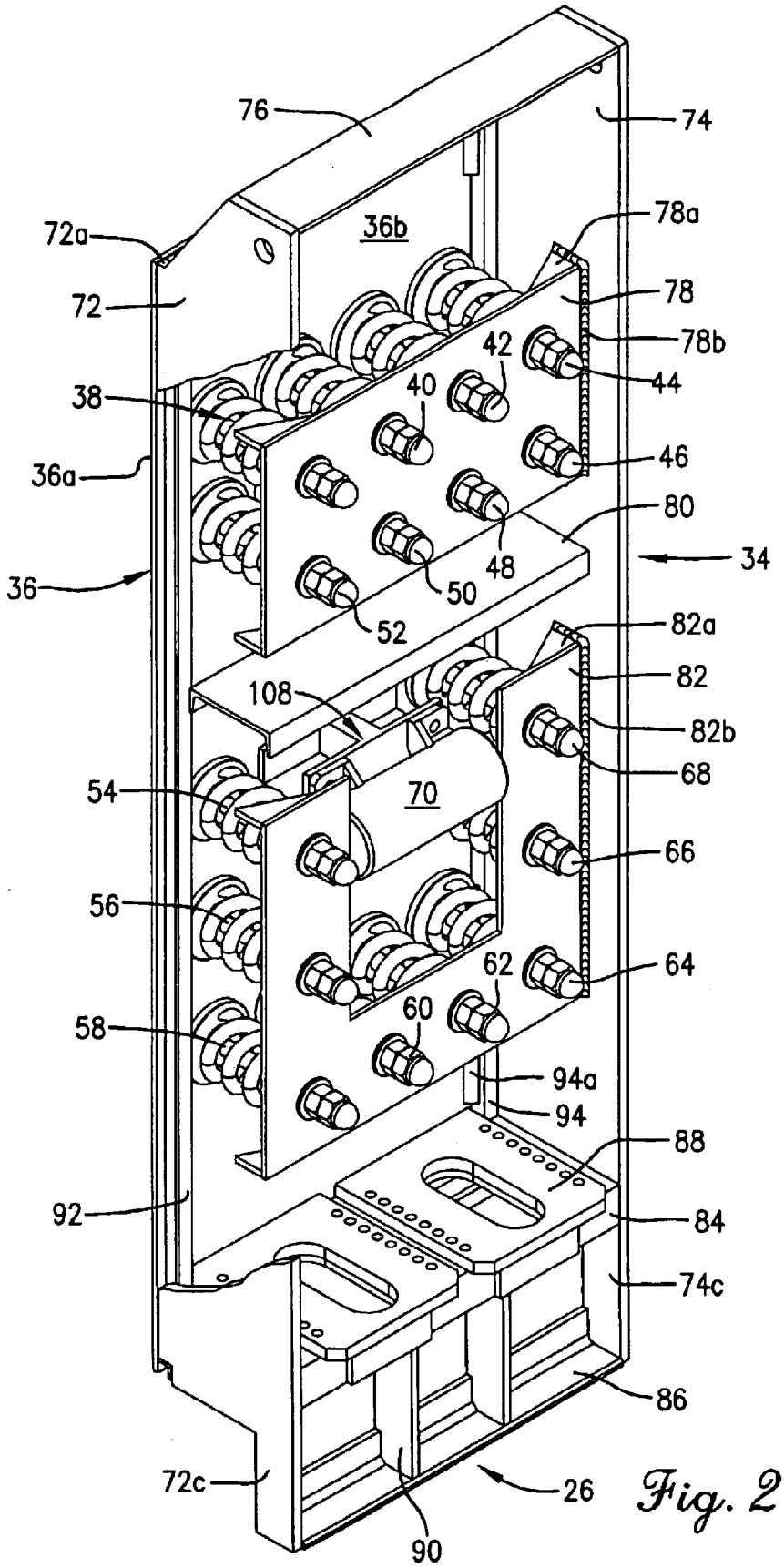
FIG. 2 is a perspective view of one of the modular jacket sections of the system illustrated in FIG. 1 with portions of the sidewall broken away to show the springs coupled between the frame and the displaceable panel.

FIG. 1 illustrates a forming system 10 constructed in accordance with a preferred embodiment of the present invention and configured for forming concrete box culverts. Although the principles of the present invention are particularly well suited for forming systems used to form concrete box culverts, the principles of the present invention are equally applicable to virtually any forming system utilizing external compaction to provide densification of the molded material. The illustrated system 10 broadly includes a pallet 12, a core 14, a jacket 16, and a header 18.

The illustrated system 10 is a modular forming system, therefore, as detailed below, each of the components 12,14, 16,18 include a plurality of sections that are removably coupled together. In this manner, the forming system 10 can be readily adapted to form variously dimensioned box culverts by adding additional spacer sections to the span and/or the rise portions of the form. In this regard, concrete box culverts traditionally are available in a variety of industry preferred dimensions. For example, conventional box culverts have a preferred thickness of around one-half meter and are preferably available in approximate six, eight, and/or ten foot lengths. Additionally, the preferred span and rise dimensions will vary by application, but these dimensions are typically proportioned in a two-to-one ratio of span-to-rise. In this manner, the box culverts can be joined lengthwise end-to-end, and sealed, to form the desired run for a particular application. One exemplary box culvert is illustrated in the '255 Application previously incorporated herein by reference. However, as described below, the principles of the present invention are not limited to forms for forming box culverts, or even to modular forms, and accordingly can equally be applied to any external compaction form for forming virtually any hardened, concrete-type product.

Returning to FIG. 1, in the illustrated system 10, the pallet 12 is operable to mold one of the faces of a concrete box culvert. The core 14 is encircled by the pallet 12 and is operable to mold the inner circumferential surface of the box culvert. The jacket 16 is supported on the pallet 12 and is operable to mold the outside circumferential surface of the box culvert. The header 18 encircles the core 14 and is operable to slide between the core 14 and the jacket 16 to mold the other face of the box culvert. As subsequently described in detail, the external compaction of the concrete is provided by the displaceable vibratory panels of the present invention. In the illustrated system 10, the inventive panels are provided on the jacket 16 and are configured to displaceably vibrate at or about a resonant frequency, thus providing optimal compaction of the concrete for the preferred thickness of the box culvert. However, it is within the ambit of the present invention to provide the displaceable vibratory panels on the system components other than the jacket 16 or in addition to the jacket 16. For example, for applications requiring a finished culvert having a thickness larger than one-half meter, the vibratory panels of the present invention are preferably included on both the jacket 16 and the core 14 to optimize compaction.

The pallet 12, the core 14, and the header 18 are conventional components of a culvert forming system and can be variously configured in any suitable manner known in the art. Accordingly, these components will only be briefly described with the understanding that those of ordinary skill in the art can readily configure these components in any suitable manner to cooperate with the inventive jacket 16 detailed below. The illustrated pallet 12, core 14, and header 18 are preferably modular components configured in accordance with the principles of the preferred embodiment disclosed in the '255 Application previously incorporated by reference herein as is necessary for a complete understanding of the present invention. Particularly, the pallet 12 and the header 18 preferably include a plurality of segments removably coupled together by the inventive keyed system disclosed in the '255 Application. The pallet 12 and the core 14 cooperate with the jacket 16 to provide an annular recess into which the concrete is poured. The header 18 is configured to fit within the recess to complete the form in which the concrete will be molded to form the finished box culvert. The jacket 16 operates as described in detail below to compact the concrete as it is molded within the form.

The jacket 16 is supported vertically on the pallet 12 and is operable to mold the outside circumferential surface of the box culvert. The illustrated jacket 16 is a modular jacket and includes four corner sections (with only the corner sections 20, 22, and 24 being shown in FIG. 1) and four spacer sections 26, 28, 30, and 32 removably interconnecting the corner sections. The spacer sections 26 and 30 are virtually identically configured and the sections 28 and 32 are virtually identically configured. The sections 28,32 are differently dimensioned from the sections 26,30. As detailed below, these differing dimensions require some slightly differently configured components. However, the sections 26,28,30,32 are similar in construction in many important respects and therefore only the section 26 will be described in detail with the understanding that the sections 28,30,32 are similarly constructed, except where noted below. The corner sections 20,22,24 are similar to the spacer section 26 in many important respects, however, the differences will be detailed below after the section 26 has been described in detail. The illustrated spacer section 26 broadly includes a stationary frame 34, a displaceable vibratory panel 36, a plurality of spring assemblies 38,40, 42, 44, 46, 48, 50, 52, 54, 56, 58, 60, 62, 64, 66, and 68 shiftably coupling the panel 36 to the frame 34, and a vibrator 70 coupled to the panel 36 for reciprocating the panel 36 relative to the frame 34.

In more detail, and turning to FIGS. 2–5, the frame 34 is a rigid frame that is configured to be supported on the pallet 12 and oriented vertically relative to the pallet 12 and thus the ground. The illustrated frame 34 includes a pair of substantially flat, vertically extending sidewalls 72 and 74. The sidewalls 72,74 are horizontally spaced from one another and are fixedly joined by a top plate 76, an upper back plate 78, an upper transverse support 80, a lower back plate 82, a lower transverse support 84, and a bottom plate 86. Each of the sidewalls 72,74 presents a forward-most edge 72*a* and 74*a*, respectively (see FIG. 5). The sidewalls 72,74 are configured to support the frame 34 on the pallet 12 and to cooperate with the header 18 to properly position the header 18. In this regard, the top of each of the sidewalls 72,74 angles from the top edge toward the forward-most edge 72*a*, 74*a* to define a ledge 72*b* and 74*b*, respectively, adjacent the forward-most edges 72*a*, 74*a*. The top plate 76 is shaped to complement the top profile of the sidewalls 72,74. In this manner, the frame 34 presents an angled top surface that slopes to a ledge to facilitate positioning the header 18 at least partially supported on the ledge (see FIG. 1). The bottom of each of the sidewalls 72,74 is L-shaped to define a foot portion 72*c* and 74*c*, respectively, that is recessed from the forward-most edge 72*a*, 74*a*. In this manner, the sidewalls 72,74 are configured to engage the pallet 12 and thereby support the frame 34 thereon. For purposes that will subsequently be described, each of the sidewalls 72,74 is notched at the bottom adjacent the forward-most edge 72*a*, 74*a*.

The upper back plate 78 is rigidly and sturdily fixed between the sidewalls 72,74 by gussets 78*a* and welds 78*b*. The back plate 78 includes a plurality of apertures formed through the plate 78 and configured to slidably receive the spring assemblies 38,40,42,44,46,48,50,52. The upper support 80 extends between the sidewalls 72,74 and is configured to couple and reinforce the sidewalls 72,74 (e.g., formed of an angle iron weldment, etc.). The lower back plate 82 is similar in configuration to the previously described back plate 78 and is fixed between the sidewalls 72,74 by gussets 82*a* and welds 82*b* for slidably receiving the spring assemblies 54,56,58,60,62,64,66,68. However, the back plate 82 is U-shaped to provide adequate clearance for the vibrator 70 as detailed below. The lower support 84 is configured similar to the upper support 80 described above and extends between the sidewalls 72,74 to couple and reinforce the sidewalls 72,74. However, unlike the upper support 80, the lower support 84 is configured to receive a pair of pallet locators 88. In one manner known in the art, the pallet locators 88 facilitate properly aligning the jacket section 26 on the pallet 12 during assembly to achieve the desired width for the annular recess. The bottom plate 86 extends between the foot portions 72*c*, 74*c* of the sidewalls 72,74 and is channel-shaped to enhance the strength and support of the plate 86. In this regard, the lower support 84 is reinforced by trusses 90 coupled between the support 84 and the plate 86.

The remaining components of the jacket section 26, including the panel 36, the spring assemblies 38–68, and the vibrator 70 are all supported on the frame 34. Accordingly, the frame 34 must be sufficiently rigid and sturdy and is therefore preferably formed of a sturdy metal (e.g., an iron alloy such as steel, etc.). However, as further detailed below, the principles of the present invention significantly reduce the vibratory forces acting on the frame 34 during the compaction of the concrete culvert during formation over the prior art forming systems. In this regard, the frame 34 could be formed of substantially lighter weight materials (e.g., lighter weight steel, aluminum, etc.) than prior art frames. However, it is within the ambit of the present invention to modify existing prior art frames for use in the jacket 16 (e.g., adding the back plates 78,82, etc.). The frame 34 remains generally stationary during the compaction of the concrete culvert during formation. In this regard, the frame 34 is preferably rigidly coupled to the frames of the adjacent jacket sections (e.g., the corner sections including the corner section 20) during assembly, such as by bolting or the like. Because the illustrated forming system 10 is modular, the frame 34 is preferably removably coupled to the adjoining frames, however, the frames could be permanently fixed together. Additionally, the frame 34 could also be coupled to the pallet 12, such as with clamps or the like. The frame 34 could be variously configured so long as the frame is operable to support the remaining components of the jacket and remain relatively stationary during compaction of the concrete.

The panel 36 is associated with the frame 34 and, as will be detailed below, is displaceable and vibratory relative thereto. The panel 36 engages the concrete during formation of the box culvert for both molding and compaction of the concrete as the concrete is molded. In more detail, the illustrated panel 36 is a substantially flat, uniform panel presenting a planar front surface 36*a* and an opposed, planar back surface 36*b*. The surfaces 36*a*, 36*b* are coextensive with the panel 36 and each other. The front surface 36*a* engages the concrete during formation of the box culvert. The panel 36 includes orthogonal outer most edges extending transversely between the surfaces 36*a*, 36*b*. In this manner, the illustrated panel 36 is rectangular in configuration. As indicated above, the jacket section 26 cooperates with adjacent jacket sections removably coupled thereto to define the forming surface for molding the outer circumferential surface of the box culvert. Accordingly, the outer edges of the panel 36 are preferably configured to extend over the forward-most edges 72*a*, 74*a* of the frame walls 72,74 so as to be substantially even with the outer margins of the walls 72,74. In this manner, the plate 36 is configured to closely abut the outer edges of the adjacent panels to generally prevent concrete from seeping between the abutting panels without hindering the vibratory displacement of each of the panels. In this regard, the illustrated panel 36 is preferably formed from machined steel that is finished once the panel 36 is assembled to the frame 34 to ensure smooth edges that are coextensive with the outer margins of the frame walls 72,74.

In order to further facilitate the prevention of concrete from seeping between the panels during formation of the box culvert, the panel 36 also includes gasket-receiving channels 92 and 94 fixed (e.g., with gussets 92*a* and 94*a*, respectively) to the inside of the back surface 36*b*, and extending along, and adjacent to, the entire forward-most edges 72*a*, 74*a* of the frame walls 72,74 when the panel 36 is assembled to the frame 34 (see FIGS. 3 and 5). The panel 36 also includes a gasket-receiving channel 96 fixed to (e.g., with gussets 96*a*) the back surface 36*b* along the bottom edge that rides in the notch in the sidewalls 72,74. Each of the channels 92,94,96 is configured to receive corresponding gaskets 98, 100 and 102, respectively. The illustrated gaskets 98,100,102 are formed of rubber and are configured to generally seal against the frame walls 72,72 and the pallet 12, respectively. Each of the gaskets 98,100,102 is sized and dimensioned to engage the back surface 36*b* and extend therefrom sufficiently past any gap between the panel 36 and the forward-most edges 72*a*, 74*a* (as detailed below). In this regard, the illustrated gaskets 98,100,102 are at least about fifteen millimeters thick, although any suitable thickness could be used. Although not illustrated, the panel 36 could also include a gasket along and adjacent the ledges 72*b*, 74*b* extending under and along the top plate 76. The panel 36 could be variously configured to prevent seepage of concrete around the panel 36. However, it is important that the sealing method does not interfere with the displaceable vibratory functioning of the panel.

As indicated above, the panel 36 is displaceable and vibratory relative to the frame 34. In this regard, the back surface 36*b* of the panel 36 must be sufficiently spaced from the forward-most edges 72*a*, 74*a* of the frame sidewalls 72,74 to enable the panel 36 to vibrate without interferingly engaging the sidewalls 72,74. Accordingly, the illustrated panel 36, when assembled to the frame 34 as detailed below, defines corresponding gaps 104 and 106 between the back surface 36*b* and the forward-most edges 72*a*, 74*a*, respectively, of the frame sidewalls 72,74. The illustrated gaps 104,106 are preferably uniform, and for purposes that will subsequently be described, are preferably greater than 0.55 millimeters. In this regard, the illustrated gaps 104,106 are each substantially about two millimeters. It is believed a gap dimension of two millimeters is sufficient to enable the panel 36 to vibrate relative to the frame 34 at or about a resonant frequency as described below, yet is sufficiently small enough to generally prevent concrete from undesirably seeping between the panel 36 and the frame 34. However, the gaps 104,106 could be alternatively configured, such as varying the gaps at the bottom to provide a slightly tapered surface to facilitate subsequent stripping (in the system 10 this could be accomplished by adjusting the spring settings detailed below rather than having to machine the taper into the panel itself). Additionally, because vibration at a resonant frequency is desirable, the panel 36 must be sufficiently flexible to enable such vibration, yet sufficiently sturdy to both withstand such vibration and to mold the concrete as it forms. As indicated above, the panel 36 is preferably formed from machined steel and suitable dimensions for the illustrated panel 36 are preferably about one-third inch thick (e.g., eight millimeters) and presenting about a two foot width dimension (e.g., 610 millimeters) and a six foot height dimension (e.g., 1824 millimeters). However, it is within the ambit of the present invention to variously size and dimension the panels to provide any desired dimensions for the jacket sections. For example, the spacer sections 28,32 include panels having a one foot width dimension (e.g., 305 mm) and the corner sections include panels having three and one half feet by two and a half feet width dimensions (e.g., 1095 mm by 638 mm).

As indicated above, the vibrator 70 is coupled to the panel 36. Particularly, the panel 36 includes a vibrator mounting bracket 108 fixed to the back surface 36*a* and configured to rigidly receive the vibrator 70. In more detail, the mounting bracket 108 includes a mounting pad 110 that is spaced from the back surface 36*b* by a gusset 112. The pad 110 presents a plurality of bolt-receiving apertures for coupling the vibrator 70 thereon. The gusset 112 is configured to not interfere with the apertures. The gusset 112 fixes the pad 110 to a mounting plate 114 that is welded to the back surface 36*b* of the panel 36. It is within the ambit of the present invention to utilize conventional accessories with the panel 36, such as lift hole pins (not shown) for facilitating lifting the form. However, it is important that these accessories are configured to not interfere with the vibratory displacement of the panel 36.

As previously indicated, the plurality of spring assemblies 38–68 shiftably couple the panel 36 to the frame 34. The spring assemblies 38–68 support the panel 36 on the frame 34 and enable the vibratory displacement of the panel 36 relative to the frame 34. Each of the spring assemblies 38–68 are virtually identically configured and therefore only the spring assembly 38 will be described in detail with the understanding the spring assemblies 40–68 are similarly constructed. Turning to FIGS. 5 and 6, the spring assembly 38 broadly includes a collar 116, a shaft 118, a spring 120, a bushing 122, a locking washer 124, a ring nut 126, a pair of flat washers 128 and 130, a pair of spring discs 132 and 134, and a pair of end nuts 136 and 138. In more detail, the illustrated collar 116 is fixed to the back surface 36*b* of the panel 36 by a plurality of welds 116*a* and is configured to threadably receive one end of the shaft 118 (e.g., internally threaded) and configured to guidingly engage one end of the spring 120. The shaft 118 is fixed relative to the panel 36 and shiftable relative to the frame 34. In this regard, the illustrated shaft 118 includes external threading on each of its ends and one end thereof is threaded into the collar 116. The shaft 118 is configured to cooperate with the shafts of the other spring assemblies 40–68 to support the weight of the panel 36 on the frame 34. In this regard, the illustrated shaft 118 is a steel shaft having a one inch diameter.

The spring 120 is configured to cooperate with the uniformly similar springs of the other spring assemblies 40–68 to enable reciprocation of the panel 36 by the vibrator 70 (as detailed below). The spring 120 is received between the collar 116 and the bushing 122 and encircles the shaft 118 to yieldably bias the panel 36 away from the forward-most edges 72*a*, 74*a* of the frame 34 to define the previously described gaps 104,106. As detailed below, the stiffness of the spring 120 will impact the number of springs required to support the panel 36 on the frame 34 to provide the desired vibratory displacement of the panel 36 by the vibrator 70. In this regard, the spring stiffness is preferably sufficient to enable the use of a minimal amount of springs while still enabling the desired reciprocation in a cost-effective manner. For example, the illustrated spring 120 is formed of a spring steel (e.g., En42 steel) wire preferably having a shear modulus of generally about 80 $e^9$ $N/m^2$, a wire diameter of about one inch (e.g., 0.0254 m), and four active coils presenting a mean coil diameter of four inches (e.g., 0.1016 m). The springs of the other spring assemblies 40–68 are similarly and preferably uniformly configured. However, it will be appreciated that manufacturing tolerances may not enable all the illustrated springs to have an exactly uniform shear modulus. As will subsequently described in detail, the actual shear modulus of the springs will impact the number of springs needed to provide the desired vibratory displacement of the illustrated panel 36. As detailed below, if all of the springs included the preferred shear modulus given above, the desired vibrator displacement of the panel 36 could be achieved by the vibrator 70 with only thirteen springs supporting the panel 36 on the frame 34. Although the spring 120 could be variously configured, the spring stiffness will directly affect the number of springs required to provide the desired vibratory displacement of the panel.

The bushing 122 is slidably received over the end of the shaft 118 distal to the panel 36 and is configured to engage the spring 120 to facilitate isolating the movement of the spring 120 between the bushing 122 and the collar 116. Particularly, the bushing 122 is urged by the spring 120 against the upper back plate 78 of the frame 34. The bushing 122 is configured to allow the shaft 118 to shift relative to the bushing 122. The bushing 122 includes a back recess 122*a* configured to receive the locking washer 124 and the ring nut 126 when assembled. The locking washer 124 and the ring nut 126 enable the spring 120 to be preloaded (depending on the stiffness of the spring used) and cooperate to facilitate isolation of the movement of the spring 120 without shearing the shaft 118. Particularly, the ring nut 126 is threaded onto the distal end of the shaft 118 to engage the locking washer 124 between the bushing 122 and the back plate 78. In this manner, the spring 120 urges the bushing 122 against the locking washer 124 and the ring nut 126. The distal end of the shaft 118 shiftably extends through the aperture in the back plate 78 until the ring nut 126 and the bushing 122 engage the back plate 78.

As previously indicated, the shaft 118 supports the panel 36 on the frame 34 and must enable the spring 120 to adequately vibrate the panel 36 relative to the frame 34. Particularly, the end nuts 136 and 138 are threadably received on the distal end of the shaft 118 exterior to the back plate 78 to retain the shaft 118 supported on the back plate 78. The end nut 138 is a cap nut that locks against the end nut 136. The end nut 136 must be sufficiently spaced from the back plate 78 to enable the shaft 118 to shift sufficiently to enable the desired displacement of the panel 36 relative to the frame 34, yet enable the desired supporting function of the shaft 118. In this regard, the illustrated flat washers 128,130 and the spring discs 132,134 are slidably received on the distal end of the shaft 118 and space the end nut 136 sufficiently from the plate 78 while enabling the shaft 118 to shift relative to the plate 78 to enable the displacement of the panel 36. As detailed below, the illustrated panel 36 preferably displaces at least about 0.55 millimeters relative to the forward-most edges 72*a*, 74*a* of the frame sidewalls 72,74 within the gaps 104,106. The illustrated spring discs 132,134 are therefore configured to enable and maintain this 0.55 millimeter displacement. The illustrated spring discs 132,134 are Belleville washers having at least a one inch inner diameter and cooperating when loaded to yieldably flex about 0.55 millimeters. Suitable Belleville washers are available from Key Bellevilles, Inc. of Leechburg, Pa. as Catalog nos. B27 or HDS27.

As previously indicated, the spring stiffness of the spring 120 (and the similar springs of the assemblies 40–68) is preferably sufficient to enable the use of a minimal amount of springs while still enabling the desired reciprocation of the panel 36 in a cost-effective manner. Particularly, the number of springs necessary to enable the desired reciprocation is directly related to the spring stiffness, the characteristics of the panel material, and the desired frequency of vibration. In this regard, it has been determined that the number of springs needed to vibrate a particular panel at a desired frequency is generally estimated by the following formula:

$$N=(32n\pi^2f^2D^3W)/(Gd^4)$$

wherein,

N=number of springs needed n=number of active turns in each spring $\pi$=22/7 f=frequency of reciprocation of panel (Hz)

D=mean coil diameter of each spring (m)

W=weight of the panel (kg)

G=shear modulus of spring material ($N/m^2$)

d=wire diameter of each spring (m).

For purposes that will subsequently be described, it has been determined that for the illustrated panel 36, the desired reciprocation for optimizing the compaction of the concrete with a 0.55 millimeter displacement is a vibration at sixty Hertz. As detailed above, the illustrated spring 120 has four active turns, a mean coil diameter of 0.1016 m, and a wire diameter of 0.0254 m. The illustrated steel spring 120 has an ideal shear modulus of 80 $e^9N/m^2$. As indicated above, the panel 36 is a steel panel having and area of 0.008 m×0.610 m×1.824 m. From the known specific gravity of steel (7.8 gm/cc), the weight of the panel 36 can be derived. Although the panel 36 also includes the other steel components fixed thereto, such as the collars (such as the collar 116), the channels 92,94,96, and the mounting bracket 108, these components are not included in the weight W of the panel, but rather the weight W is only in respect to the surface area of the forming surface 36*a* that engages the concrete multiplied by the thickness of the panel 36. As shown in the Table 1 on the page below, plugging these known parameters into the above equation yields the number of springs needed under ideal conditions for the panel 36 (e.g. in the column entitled "2'Jacket"):

TABLE 1

IDEAL CALCULATIONS FOR VARYING JACKET SECTIONS

| Details | 1' Jacket | 2' Jacket | 3' Jacket | 4' Jacket | Corner Jacket |
|---|---|---|---|---|---|
| Fluttering Panel Size | | | | | |
| Thickness: t (M) | $8 \times 10^{-3}$ | $8 \times 10^{-3}$ | $8 \times 10^{-3}$ | $8 \times 10^{-3}$ | $8 \times 10^{-3}$ |
| Width: b (M) | 0.3048 | 0.6096 | 0.9144 | 1.2192 | 1.734 (0.638 + 1.095) |
| Height: h (M) | 1.824 | 1.824 | 1.824 | 1.824 | 1.824 |
| Operational Condition | | | | | |
| Acc$^n$ Due to gravity: g ($M/s^2$) | 9.81 | 9.81 | 9.81 | 9.81 | 9.81 |
| Acc$^n$ of Vibration: gl ($M/s^2$) | 8 g | 8 g | 8 g | 8 g | 8 g |
| Frequency of Excitation: f (rad/s) | $2\pi \times 60$ | $2\pi \times 60$ | $2\pi \times 60$ | $2\pi \times 60$ | $2\pi \times 60$ |
| Material Properties of the Panel | | | | | |
| Young's Modulus of Elasticity: E ($N/M^2$) | $210 \times 10^9$ | $210 \times 10^9$ | $210 \times 10^9$ | $210 \times 10^9$ | $210 \times 10^9$ |
| Density: p ($Kg/M^3$) | 7800 | 7800 | 7800 | 7800 | 7800 |
| Poisson's ratio: $\eta$ | 0.3 | 0.3 | 0.3 | 0.3 | 0.3 |
| Derived Parameters | | | | | |
| Weight of Panel = t × b × h × p: W (Kg) | 34.69 | 69.38 | 104.3 | 139 | 197.8 |
| Total stiffness needed = W × $f^2$: K (N/M) | $4.93 \times 10^6$ | $9.86 \times 10^6$ | $14.83 \times 10^6$ | $19.8 \times 10^6$ | $28.2 \times 10^6$ |
| Details of spring | | | | | |
| No. of active coils: n | 4 | 4 | 4 | 4 | 4 |
| Wire dia. of spring: d (M) | $20 \times 10^{-3}$ | $20 \times 10^{-3}$ | $20 \times 10^{-3}$ | $20 \times 10^{-3}$ | $20 \times 10^{-3}$ |
| Mean dia of spring: D (M) | $80 \times 10^{-3}$ | $80 \times 10^{-3}$ | $80 \times 10^{-3}$ | $80 \times 10^{-3}$ | $80 \times 10^{-3}$ |
| Shear modulus: G ($N/M^2$) | $80 \times 10^9$ | $80 \times 10^9$ | $80 \times 10^9$ | $80 \times 10^9$ | $80 \times 10^9$ |
| Spring stiffness = $Gd^4/8nD^3$: Ks (N/M) | $781.25 \times 10^3$ | $781.25 \times 10^3$ | $781.25 \times 10^3$ | $781.25 \times 10^3$ | $781.25 \times 10^3$ |
| Output Parameters | | | | | |
| No. of Springs required = (K/Ks): N | 6.31 | 12.62 | 19 | 25.34 | 36.09 |
| No. of springs rounded off | 6 | 13 | 19 | 26 | 36 (14 + 22) |
| Deflection of the panel = $(gl/f^2)\ 10^3$: $\delta$ (mm) | 0.552 | 0.552 | 0.552 | 0.552 | 0.552 |
| Force required to achieve: F (KN) above deflection & 'g' level $K \times \delta \times 10^{-6}$ | 2.72 | 5.45 | 8.2 | 10.93 | 15.56 |

Table 1 includes the calculation of the number of springs N for six foot tall jacket sections having the various width dimensions listed. The estimated number of springs N provided are based on the assumption that all of the springs have the ideal, uniform shear modulus given. The illustrated panel 36 is a two foot wide panel and the number of springs N needed under ideal conditions is shown in Table 1 as thirteen springs.

The illustrated panel 36, however, includes sixteen spring assemblies 38–68, not thirteen spring assemblies. This is because, as indicated above, the shear modulus for the springs in application is rarely ideal, at least not uniformly ideal for all of the springs. The shear modulus G should be actually measured for each of the springs that will actually be used in the jacket prior to arriving at the final design. Once the actual spring modulus is measured, it can be used in the above formula and recalculated to arrive at the actual number of springs needed. In this manner, the panel 36 is illustrated as having sixteen springs to more closely resemble the inventive panel in actual practice.

As indicated in Table 1, it will be appreciated that the above formula can be derived from the proposition that N=K/Ks, where K is the total stiffness needed and Ks is the actual stiffness of one of the uniformly designed springs. Both K and Ks can be derived using the geometric details and material properties of the panel and the spring design, known operational conditions, and intermediate derived parameters. The panel details and properties include the above described panel dimensions and the density of the panel material, as well as Youngs modulus of elasticity (e.g., 210 $e^9 N/m^2$) and Poisson's ratio (e.g., 0.3). The spring design details include the factors n, d, and D defined above, as well as the shear modulus of the spring material. The operational conditions include the acceleration due to gravity g (e.g., 9.81 $m/s^2$), the acceleration of vibration g1 (e.g., 8 g), and the frequency of excitation fe (in rad/s=$2f\pi$). The total stiffness $K=fe^2W$. The designed stiffness $Ks=(d^4G)/(8nD^3)$.

In addition to the output parameter N, as shown in Table 1, the above parameters can also be used to calculate the necessary displacement of the panel 36 (i.e., the amplitude of displacement) to achieve the desired frequency, as well as the necessary force required to ensure the necessary displacement. The displacement of the panel in millimeters, $\delta=(g1/f^2)e^3$. The necessary force $F=(K)(\delta)(1\ e^{-6})$. It will be appreciated that the above output parameters are all directly related to the desired frequency of vibration of the panel 36.

As detailed above, for the illustrated panel 36, the desired frequency has been determined to be about 60 hz. In this regard, the frequency preferably approaches a resonant frequency for concrete. That is to say, where the frequency and the amplitude of the vibration of the concrete match, a resonant frequency is achieved. Vibration of the concrete at a resonant frequency will provide optimum compaction of the concrete. Because, the panel 36 displaces, the frequency at which the panel 36 vibrates is predominantly transferred to the concrete. The frequency of 60 Hz for the illustrated panel 36 has been selected because this is the natural frequency in the United States and thus facilitates ready cooperation of the system 10 with other power sources, equipment, etc. However, the selected frequency could be other than 60 Hz (e.g., in Europe, the natural frequency is 50 Hz, and thus 50 Hz is preferred for systems utilized in Europe). Accordingly, the desired frequency of vibration of the panel 36 has been designed to be 60 Hz. It will be appreciated that the displaceable panels of the present invention enable the frequency of vibration of the panel to be directly transferred to the concrete, however, there may be some frequency reduction in the transfer. Nonetheless, the displaceable panels of the present invention provide significantly more frequency transferred to the concrete than with the prior art rigid panels. That is to say, the prior art panels primarily achieved only amplitude of vibration, but no sustainable frequency. The panel 36, however, displaces to obtain both amplitude and sustainable frequency of vibration of the concrete. Furthermore, the spring assemblies 38–68 enable the displacement of the panel 36 to be synchronized with the frequency of vibration to achieve at or about a resonant frequency, greatly increasing the compaction capabilities of the panel 36.

As detailed above, once the desired frequency of vibration of the panel 36 has been established, the desired displacement $\delta$ can be derived, as well as the necessary force F to ensure the desired displacement. As previously indicated, the desired displacement of the panel 36 is 0.55 mm. Using these parameters, and as shown in Table 1 above, the desired force F required to displace the panel 36 under ideal conditions is 5.45 KN. In the illustrated section 26, this force required to vibrate and displace the panel 36 is provided by the vibrator 70. Particularly, the vibrator 70 is coupled to the panel 36 by bolting the vibrator 70 to the mounting bracket 108. The illustrated vibrator 70 is an eccentric motor that can be adjusted, or tuned, to provide the desired force and frequency of vibration. In one manner known in the art, the motor rotates an eccentric fly wheel and the eccentric fly wheel includes variously spaced pin-receiving apertures along its eccentric periphery. In this manner, pins can be placed in the desired aperture to tune the motor to the desired setting. Suitable motors are available from ISKCO, Ltd. of Maumelle, Ariz. as Model Nos. HKM55LFS, HKM75FLS, and HKM75BL. As shown in Table 1 above, the necessary force F varies with the dimensions of the panel being vibrated. Accordingly, each vibrator must be tuned to correspond to its particular panel. Because the vibrator 70 can be operated significantly below its upper operating limits (unlike vibrators used in prior art systems), the vibrator 70 suffers substantially less wear and thus incurs lower maintenance needs and is longer lasting.

The displaceable vibratory panel 36 provides superior compaction of concrete over the prior art forming systems. The inventive panel 36, unlike the prior art panels, effectively transfers both amplitude and frequency of vibration to the compacting concrete. In this manner, the vibration of the concrete can approach a resonant frequency for optimizing compaction, without the need for the large amplitudes of vibration implemented in the prior art panels. The near resonant frequencies enable a considerably lower water/cement ratio to be used thereby increasing the strength of the finished box culvert, or reducing the amount of cement needed. For example, while prior art forming systems required at least a 1:3 water to cement ratio, it is believed the forming system 10 can utilize as little as a 1:4 ratio although about a 0.26 proportion is preferred. The lower water/cement ratio provides smaller creep and shrinkage, greater density and thus smaller permeability and improved frost resistance, greater wear resistance and resistance to atmospheric and chemical agencies, increased moduli of elasticity and rupture and improved bond strength. The reduced vibratory forces needed enable the frame 34 to be lighter weight and still last longer and require lower undesirable maintenance. It is within the ambit of the present invention to utilize various alternative configurations for the panel 36 and the method of displacing and vibrating the panel relative to the frame 34. However, it is important that the panel configuration enables the panel to be vibratorily displaced relative to a stationary frame.

As previously indicated, the spacer section 30 is configured similarly to the section 26 as detailed above. However, the spacer sections 28 and 32 are alternatively configured to provide a varying spacer dimension for the rise of the culvert. As indicated above, the spacer sections 28,32 are one foot jacket sections. As shown above in Table 1, the sections 28,32 each include six spring assemblies coupling the one foot panels to the frames and require a 2.72 KN force to vibrate the one foot panels at 60 Hz and displace the panels the desired 0.55 mm. The sections 26,28,30,32 could be variously alternatively configured. However, the above formula is preferably used to determine the number of springs N necessary to provide the desired displacement and frequency of vibration consistent with those provided by the illustrated section.

As indicated above, the corner sections 20,22,24 are similar to the spacer section 26 in many important respects, however, these section differ from the spacer sections 26,28, 30,32 in some respects. As shown in FIG. 1, the corner sections each include an L-shaped rigid frame and a pair of independently displaceable, vibratory panels spring coupled to a respective arm of the L-shaped frame. The pair of panels of the illustrated corner sections 20,22,24 preferably present about three and one half foot and two and one half foot widths. In this regard, each of these panels includes a different number of spring assemblies N calculated in accordance with the formula detailed above. As with the panel 36 detailed above, the number of springs N given in the Table 1 is under ideal conditions, however, the illustrated corner sections are shown with a larger number of springs to better reflect the actual shear modulus of the springs as implemented. It should be noted that while the number N of spring assemblies is important, the placement of these assemblies is not. The panels of each corner section 20,22,24 are vibrated by a separate vibrator, tuned in accordance with Table 1, and are sealed in a manner similar to the panel 36 described above. Each of the corner sections 20,22,24 is configured to provide the preferred 0.55 mm of displacement of each panel and to vibrate each panel at the preferred 60 Hz. It should be noted that FIG. 1 illustrates the corner sections 20,22,24 positioned so that a shorter arm of one corner and a longer arm of an adjacent corner cooperate with a spacer section to make up each side of the forming system 10. However, in practice, these components are preferably arranged so that the long arms of adjacent corner sections cooperate with a spacer section to define the span sides and the shorter arms cooperate with a shorter spacer to define the run sides. However, it is within the ambit of the present invention to utilize various alternative configurations for the jacket 16, such as utilizing only corner sections without spacer sections therebetween.

As previously indicated, it is within the ambit of the present invention to provide the displaceable vibratory panels on the system components other than the jacket 16 or in addition to the jacket 16. The illustrated system 10 is well suited to provide optimum compaction of concrete having conventional thicknesses for box culverts, such as 450 mm. However, for applications requiring a finished culvert having a thickness larger than one-half meter, the vibratory panels of the present invention are preferably included on both the jacket 16 and the core 14 to optimize compaction. Additionally, the displaceable vibratory panels could be provided on concrete forming forms other than those utilized to form box culverts.

In operation, the core is bolted together to set the desired dimensions of the forming surface for forming the inner-circumferential surface of the culvert. The pallet 12 is then assembled with the necessary span and rise segments to match the dimensions of the outer surface of the assembled core 14. Each of the segments of the pallet 12 engage the outer surface of the core 14. Next, the displaceable vibratory panels of the jacket 16 are coupled to the frames with the proper number of spring assemblies. The frames of the jacket 16 are then bolted together so that the assembled jacket 16 generally matches the dimensions of the pallet 12. The frames of the jacket 16 should engage and rest upon the pallet 12. If desired, the jacket 16 may be clamped to the pallet 12. The segments of the header 18 are then assembled with the necessary span and rise segments to match the dimensions of the annular recess defined between the core 14 and the jacket 16. Next, concrete is poured into the annular recess to the desired level. The header 18 is then slid between the core 14 and the jacket 16. The vibratory displaceable panels of the jacket 16 are then vibrated by the tuned vibrators to provide compaction of the concrete as it is molded. Once the concrete is sufficiently firm, the header 18 can be removed, and the form-laden jacket can be removed from the core 14 and the culvert can be treated and/or hardened (e.g., steam cured, etc.) into the finished culvert. Alternatively, after the header 18 is removed, the remainder of the system 10 can be disassembled by unbolting the core 14 and the jacket 16 to access the box culvert.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the doctrine of equivalents to determine and assess the reasonably fair scope of the present invention as pertains to any apparatus not materially departing from but outside the literal scope of the invention as set forth in the following claims.

What is claimed is:

1. A form for forming concrete, said form comprising:

a frame operable to remain substantially stationary as concrete is molded in the form;

a displaceable panel associated with the frame and being operable to engage the concrete to thereby mold the concrete;

a plurality of springs shiftably coupling the panel to the frame; and a vibrator operable to reciprocate the panel relative to the frame while the concrete is molded;

said panel presenting a concrete-forming surface and an opposed back surface, said surfaces being coextensive with said panel, said springs being received between the frame and said back surface;

said frame including a pair of spaced outer sidewalls each defining a forward most edge adjacent said back surface.

2. The form as claimed in claim 1, said panel being oriented generally vertical relative to the ground.

3. The form as claimed in claim 1, said back surface being spaced from said forward most edges by a gap dimension.

4. The form as claimed in claim 3, said gap dimension being about two millimeters.

5. The form as claimed in claim 3, said back surface being entirely displaceable within said gap dimension.

6. The form as claimed in claim 5, said back surface being displaceable at least about one-half millimeter within said gap dimension.

7. The form as claimed in claim 1, said frame including a back plate fixed relative to said sidewalls and extending there between, said back plate being recessed relative to said forward most edges, said springs being received between said back surface and said back plate.

8. The form as claimed in claim 1, said panel including a deformable gasket extending along said back surface adjacent said forward most edges and being operable to engage said sidewalls.

9. The form as claimed in claim 1, the number of springs being proportionate to the weight of the panel.

10. The form as claimed in claim 1, said vibrator being fixed relative to the panel.

11. The form as claimed in claim 10, said vibrator comprising an eccentric motor.

12. A form for forming concrete, said form comprising:

a frame operable to remain substantially stationary as concrete is molded in the form;

a displaceable panel associated with the frame and being operable to engage the concrete to thereby mold the concrete;

a plurality of springs shiftably coupling the panel to the frame; and a vibrator operable to reciprocate the panel relative to the frame while the concrete is molded, the number of springs being proportionate to the weight of the panel, said number of springs being at least the nearest whole number to the quotient determined by the formula:

$$N=(32n\pi^2f^2D^3W)/(Gd^4)$$

wherein,

N=number of springs needed n=number of active turns in each spring

=22/7 f=frequency of reciprocation of panel (Hz)

D=mean coil diameter of each spring (m)

W=weight of the panel (kg)

G=shear modulus of spring material ($N/m^2$)

d=wire diameter of each spring (m).

13. A form for forming concrete, said form comprising:

a frame operable to remain substantially stationary as concrete is molded in the form;

a first displaceable panel associated with the frame and being operable to engage the concrete to thereby mold the concrete;

a first plurality of springs shiftably coupling the first panel to the frame;

a first vibrator operable to reciprocate the first panel relative to the frame while the concrete is molded; and a second displaceable panel associated with the frame and being operable to engage the concrete to thereby mold the concrete, said first and second panels being independently mounted relative to the frame and independently shiftable relative to each other.

14. The form as claimed in claim 13; and a second plurality of springs shiftably coupling the second panel relative to the frame, said first plurality of springs defining a first number of total springs, said second plurality of springs defining a second number of total springs.

15. The form as claimed in claim 14, said first panel presenting a first total weight, said second panel presenting a second total weight, said first and second total weights being different, said first and second number of springs being different.

16. The form as claimed in claim 15, said first number of total springs being proportionate to said first total weight in a first proportion, said second number of total springs being proportionate to said second total weight in a second proportion, said first and second proportions being at least about equal.

17. The form as claimed in claim 14, said first and second number of total springs being at least the nearest whole number to the quotient determined by the formula:

$$N=(32n\pi^2f^2D^3W)/(Gd^4)$$

wherein,

N=number of springs needed n=number of active turns in each spring $\pi$=22/7 f=frequency of reciprocation of panel (Hz)

D=mean coil diameter of each spring (m)

W=weight of the panel (kg)

G=shear modulus of spring material ($N/m^2$)

d=wire diameter of each spring (m).

18. The form as claimed in claim 17, said first and second number of total springs each equaling the nearest whole number greater than said quotient.

19. The form as claimed in claim 13; and a second vibrator operable to reciprocate the second panel relative to the frame while the concrete is molded.

20. The form as claimed in claim 13, said first panel being oriented generally vertical relative to the ground.

21. The form as claimed in claim 13, said first panel presenting a concrete-forming surface and an opposed back surface, said surfaces being coextensive with said first panel, said first plurality of springs being received between the frame and said back surface;

said frame including a pair of spaced outer sidewalls each defining a forward most edge adjacent said back surface.

22. The form as claimed in claim 21, said back surface being spaced from said forward most edges by a gap dimension.

23. The form as claimed in claim 22, said gap dimension being about two millimeters.

24. The form as claimed in claim 22, said back surface being entirely displaceable within said gap dimension.

25. The form as claimed in claim 24, said back surface being displaceable at least about one-half millimeter within said gap dimension.

26. The form as claimed in claim 21, said frame including a back plate fixed relative to said sidewalls and extending there between, said back plate being recessed relative to said forward most edges, said first plurality of springs being received between said back surface and said back plate.

27. The form as claimed in claim 21, said first panel including a deformable gasket extending along said back surface adjacent said forward most edges and being operable to engage said sidewalls.

28. The form as claimed in claim 13, said first vibrator comprising an eccentric motor.

* * * * *